United States Patent [19]
Caswell

[11] Patent Number: 4,469,055
[45] Date of Patent: Sep. 4, 1984

[54] CONTROLLED VARIABLE COMPRESSION RATIO PISTON FOR AN INTERNAL COMBUSTION ENGINE

[76] Inventor: Dwight A. Caswell, 15095 Fruitvale Ave., Saratoga, Calif. 95070

[21] Appl. No.: 161,774

[22] Filed: Jun. 23, 1980

[51] Int. Cl.³ ..... F02B 75/04
[52] U.S. Cl. ..... 123/78 B; 123/48 B; 92/82
[58] Field of Search ..... 123/48 R, 48 B, 78 R, 123/78 AA, 78 B, 193 P, 559, 561; 92/80, 82, 216, 255

[56] References Cited

U.S. PATENT DOCUMENTS

| | | | |
|---|---|---|---|
| 1,825,163 | 9/1931 | Schwetter | 123/78 B |
| 3,270,730 | 9/1966 | Timoney | 123/561 |
| 3,293,994 | 12/1966 | Napolitano | 92/82 |
| 3,303,831 | 2/1967 | Sherman | 92/82 |
| 3,667,433 | 6/1972 | Isley | 123/78 B |
| 4,031,868 | 6/1977 | Karaba et al. | 92/82 |
| 4,286,552 | 9/1981 | Tsutsumi | 123/78 B |

FOREIGN PATENT DOCUMENTS

| | | | |
|---|---|---|---|
| 741563 | 11/1943 | Fed. Rep. of Germany | 123/78 B |

*Primary Examiner*—Craig R. Feinberg
*Assistant Examiner*—W. R. Wolfe
*Attorney, Agent, or Firm*—Owen, Wickersham & Erickson

[57] ABSTRACT

The compression ratio of an engine is controlled to optimize efficiency or performance, or both. The effective length of the piston is varied to change the compression ratio, by means of one of several piston configurations for adjusting the effective piston length as measured from the wrist pin. The piston length is hydraulically controlled, by hydraulic fluid introduced into a control chamber of the piston by a conduit connected to the piston and extending through the side of the engine. The conduit is designed to accommodate the reciprocal motion of the piston, and may be in a form of a flexible helix or other suitable configuration. Multiple hydraulic fluid channels may be provided in the conduit to permit circulation of the fluid or to permit the monitoring of critical parameters. The compression ratio is preferably controlled externally to the engine; valving and other controls linked to the hydraulic conduits extending from the engine may be linked to a computer. Input information to the computer may include throttle position engine rpm, intake manifold pressure, air temperature, exhaust temperature and octane rating of the fuel. From these and other parameters, optimum compression ratio may be determined and effected by the control mechanism, for optimum performance and efficiency. With the addition of a supercharger, larger fuel charges may be introduced into the engine under conditions of heavy load, with compression ratio held at a low value, producing substantially greater power for a given size engine. Then, under normal conditions of lighter load, the compression ratio may be maximized for optimum efficiency, when less power is required. Thus, a substantially smaller engine may be used in a given vehicle than ordinarily used due to power requirements. Significant increase in efficiency results.

15 Claims, 10 Drawing Figures

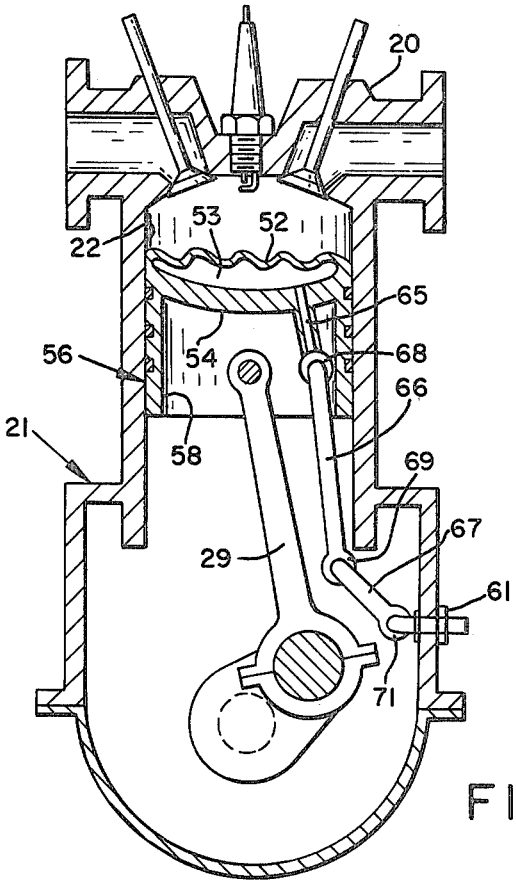
FIG. 4
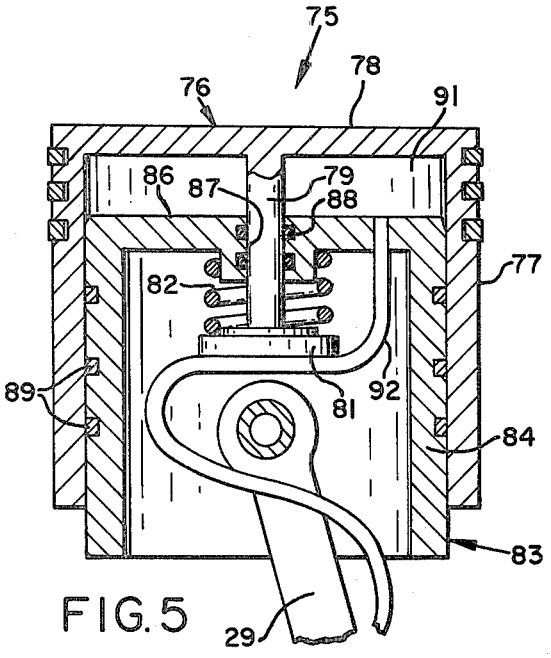
FIG. 5
FIG. 6
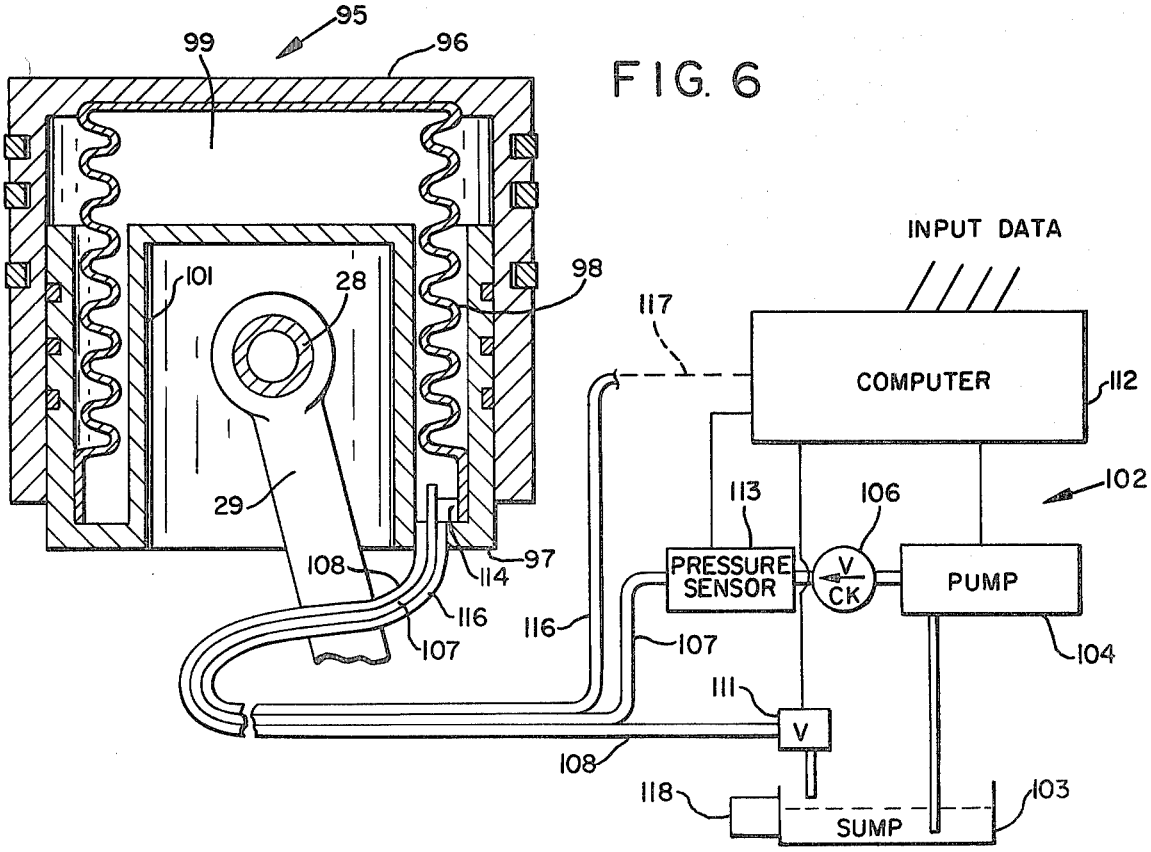

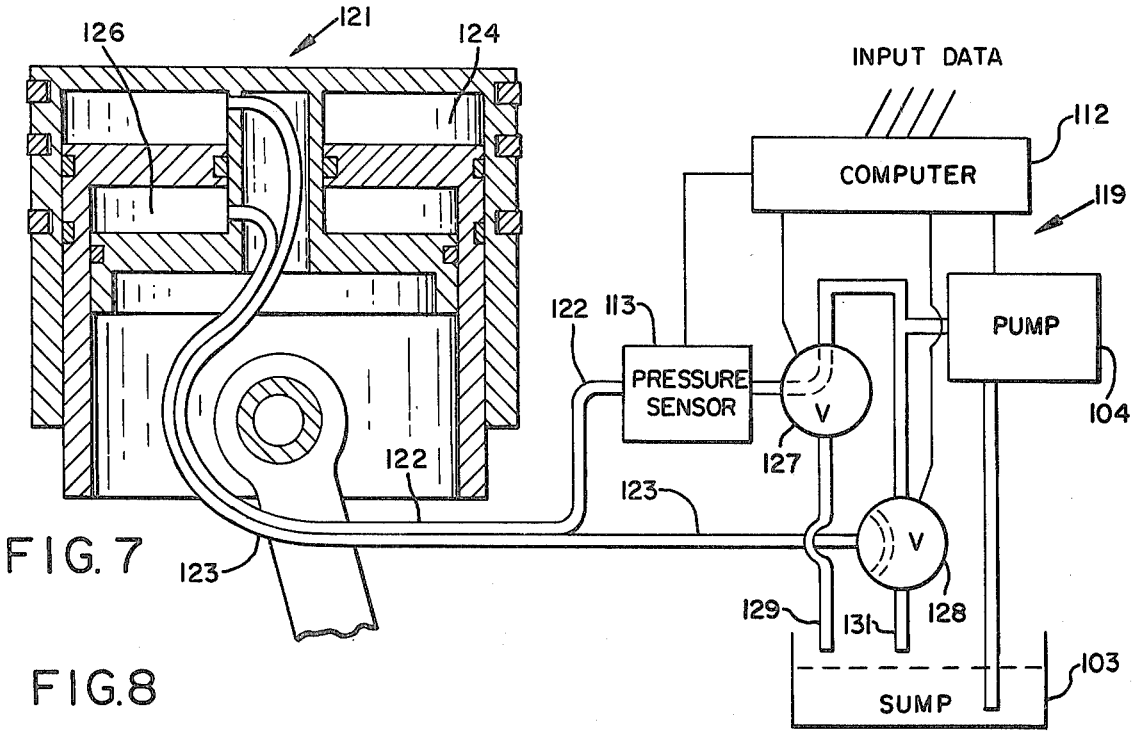
FIG. 7
FIG. 8
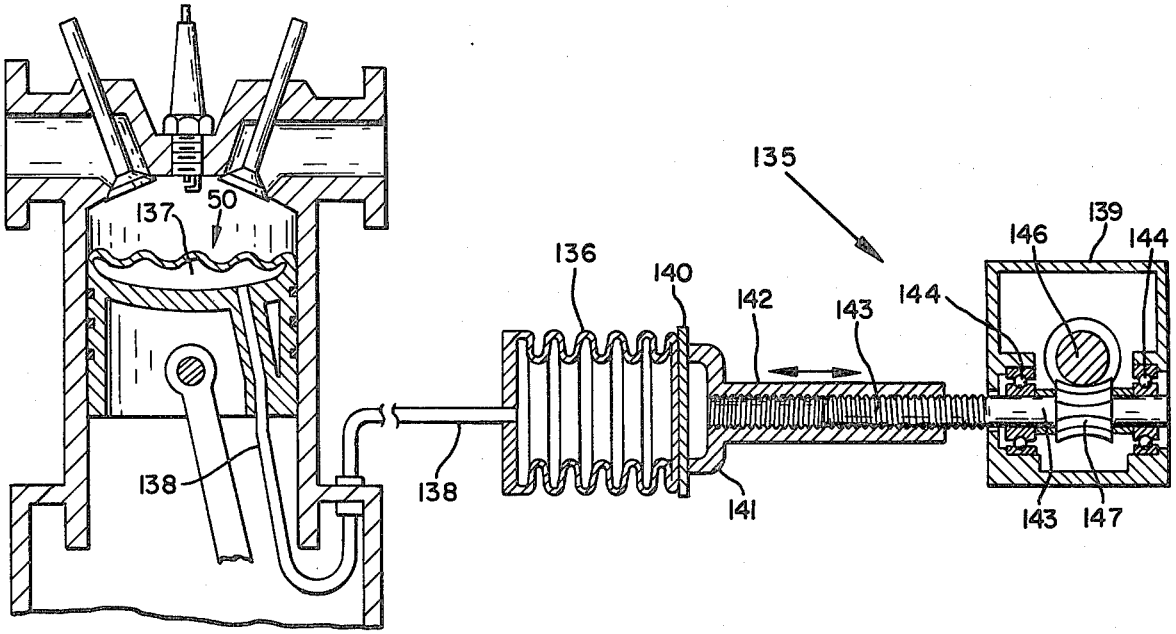

CONTROLLED VARIABLE COMPRESSION RATIO PISTON FOR AN INTERNAL COMBUSTION ENGINE

BACKGROUND OF THE INVENTION

The invention relates to a controlled variable compression spark-ignited internal combustion engine. More particularly, the invention relates to provision for adjusting the compression ratio of such an engine during operation, preferably by control external to the engine. The invention is also directed to a system employing variable compression ratio apparatus in conjunction with a supercharger, with computerized control for maximizing efficiency and performance.

Internal combustion engines are known to achieve greater efficiency with a high compression ratio, but higher compression ratio engines have a disadvantage. When operated with an open or nearly open throttle and under heavy load, the high pressure created within the combustion chamber after ignition tends to cause a secondary post-ignition explosion, commonly know as "knock" or "spark knock". In engines of fixed compression ratio, knock is prevented at open throttle and heavy load by retarding the spark or by using higher octane fuel, among other techniques. The use of higher octane fuel increases fuel costs, and the other techniques decrease engine efficiency.

Lower compression engines suffer less from knock, and can burn lower octane fuels, such as unleaded gasoline. However, at lower throttle settings and load conditions, low compression engines are less efficient than high compression engines because of the lower peak operating temperature and pressure. Usually combustion is less complete, with more unburned fuel exhausted from the engine.

It is therefore desirable to operate at the highest practical compression ratio, which is a function of operating conditions. Keeping the engine at optimum compression ratio requires varying the compression ratio to adjust for changing operating conditions. In an automobile such changes must be made while the engine is operating.

Several prior systems have been suggested to achieve a practical variable compression ratio engine. The prior systems have been of several types. The systems of one type have utilized the pressure in the combustion chamber to adjust the compression ratio on each firing of the cylinder. In essence, the peak pressure was limited so that knocking would not occur. While the principles of these systems should prevent knocking, they cannot achieve the optimum compression ratio under conditions when knocking would not normally occur. In most such systems, some reduction of the peak pressure would take place even when the peak pressure would not have caused knocking. This results in reduction of the compression ratio below optimum.

One suggested system for using a variable compression ratio piston is disclosed in U.S. Pat. No. 2,323,742. There, a two-piece piston was held together by a central connector, with an intermediate coil spring urging the two pieces apart. One problem with this system is that the movable portions of the piston and the spring were so heavy that the pressure in the combustion chamber could not overcome their inertia with the engine operating at speeds of 4000 to 6000 r.p.m. as is typical of many conventional automobile engines. A related problem of such systems is that they were capable of varying the compression ratio in response to pressure alone, and were not capable of control responsive to the many other factors that together determine the optimum compression ratio for a given condition.

Another proposed system for adjusting the compression ratio of an engine while the engine is in operation involved auxiliary chambers and pistons which alter the size of the combustion chamber. See, for example, U.S. Pat. Nos. 2,215,986 and 2,260,982. The apparatus of these systems occupies space in the engine head which is, in comtemporary engine design, occupied by valves or spark plugs. Most of the patents concerned with this concept relate to head valve and spark plug configurations which have become obsolete.

Another system for adjusting an engine's compression ratio dynamically involved the use of engine oil to hydraulically control the upper portion of a two-part piston. A number of patents have suggested apparatus under this concept, including U.S. Pat. Nos. 4,031,868; 3,450,111; 3,311,096; 3,038,458; and 2,742,027. With these systems, engine oil was supplied to the piston from the conventional oil pump, through a channel in the connecting rod. Although this approach had merit, it did not provide the control and flexibility of the present invention described below.

The following additional U.S. patents have suggested various apparatus for use with variable compression ratio pistons: 3,704,695, 3,656,412, 3,417,738, 3,403,662, 3,358,657, 3,303,831, 3,200,798, 3,161,112 and 2,376,214.

It has long been known that supercharging can be used to increase the power output of an internal combustion engine. Under some operating conditions, an engine may be taking in the maximum charge of fuel and air for which its carburetion system is designed, without being close to a condition which would cease knocking. Thus, a larger fuel-air charge can be accommodated and burned, and this can be accomplished by increasing the manifold pressure through supercharging. The supercharging introduces a larger fuel-air charge into the cylinders, increasing the power output of the engine. Because the greater power output is achieved without a significant increase in friction and heat losses of the engine, and because the pumping losses of the engine are reduced, the engine efficiency may be improved when compared with an engine of equal power output but without supercharging.

Nonetheless, supercharged internal combustion engines, at least so far as known and practiced heretofore, have not produced markedly superior efficiency. Similarily, variable compression ratio engines suggested thus far have not proven a practical means of increasing engine efficiency. Among the objects of the present invention is to provide an improved variable compression ratio engine controllable externally to the engine so that the compression ratio can be varied and optimized according to the prevailing conditions at any time, and to optionally provide, in conjunction with such an improved variable compression ratio engine, controlled supercharging so that a considerable smaller engine may be used in place of a larger engine, with compression ratio normally at a high value but reduced under conditions of heavy load, with the fuel supercharged under load conditions such that the smaller engine can be depended upon for substantially the same power output as the conventional larger engine, thereby realizing significant savings in fuel due to smaller displacement, lighter weight and more efficient combustion under most conditions.

SUMMARY OF THE INVENTION

The present invention provides an improved variable compression ratio engine as outlined above, with a compound piston connected by hydraulic conduits through the crankcase wall to an external control mechanism. Computerized control of piston pressurization may be used, responsive to a number of input parameters so that the compression ratio is always at or near the maximum permissible ratio which will not cause knocking to occur. In conjunction with this, an engine according to the invention may include a supercharger, also controlled for maximum efficiency, to supplement the power output of the engine when required. This enable the use of a much smaller engine to perform the same work as a larger engine. Under conditions requiring more power, the combustion chamber size may be increased by reducing the compression ratio, and the fuel charge introduced may be increased by supercharging. Thus, the internal cylinder pressure just before ignition can be substantially the same as for a conventional engine on the verge of knocking. The maximum fuel-air change that can be accommodated is in direct proportion to the size of the combustion chamber. For example, if the compression ratio of a variable compression ratio engine is reduced from a value of 9:1 to 7:1, the size of the combustion chamber is increased by one-third, assuming the piston stroke is constant. Thus, a one-third greater charge can be introduced into the engine when operating at the reduced 7:1 ratio. The operating efficiency of the engine will be reduced due to the lower compression ratio, but the maximum power output will be substantially increased.

In order to obtain desired acceleration and maximum speed performance in an automobile, an engine with the necessary maximum power output and torque characteristics is selected. An engine of smaller displacement, when measured at a conventional compression ratio, will be required if a supercharged, reduced compression ratio engine is used. Under most operating conditions the power output of an automobile is, of course, considerably below the required maximum. Under most driving conditions, a variable compression ratio engine can be operated at a moderately high compression ratio, substantially higher than for a conventional fixed compression ratio engine, for the particular engine and for the octane of the fuel used. Because of the relatively smaller displacement of a variable compression ratio engine according to the invention, the engine will have less heat and friction loss than a conventional engine, so that engine efficiency will be improved under most driving conditions. Because of the substantially increased power of the engine under load, it may be possible to use a six cylinder engine where an eight cylinder engine has normally been required, or a four cylinder engine in place of a six cylinder engine, or even a three instead of a four. This not only reduces the heat and friction losses, but also reduces the size and weight of the engine. Using a smaller engine presents a number of design advantages in addition to increased efficiency.

When engine operating conditions are such that the required power output is minimal, the smaller variable compression ratio engine may be adjusted to a maximum compression ratio (i.e., the maximum ratio permissible without knocking under such optimum conditions), with further efficiency improvement.

According to the invention, an internal combustion engine piston is provided whose size can be controlled according to prevailing operating conditions. Changing the piston size changes the compression ratio of the engine. In one preferred embodiment the piston is controlled from a control means external to the engine block, through a special flexible control linkage which allows for movement of the piston and the connecting rod. In another preferred embodiment the piston can be controlled either externally or internally, and a supercharger is included on the engine to supplement power as described above, with compression ratio reduced.

The mechanism for adjusting the piston may take several forms, but a two-part piston is preferred with the upper part movable in response to changes in volume in an expansible fluid chamber contained in the piston. With such a system, hydraulic fluid is introduced to the piston via a special conduit or channel which is either wholly flexible or provided with flexible or rotatable joints such that one end of the conduit moves with the piston and one end is fixed relative to the engine block. More than one fluid channel may be provided in the conduit to permit fluid circulation or to permit separate control of two control chambers or to facilitate transmission of information from sensing devices associated with the piston.

One or more hydraulic control chambers are provided in the piston such that introduction or removal of fluid from the chamber or chambers adjusts the height of the piston via a movable head portion, thereby varying the size of the combustion chamber at top dead center piston position and changing the compression ratio. Control of the compression ratio is achieved preferably by suitable control mechanisms external to the piston and fixed relative to the engine block. Either sealed or unsealed hydraulic systems may be used. With a sealed (closed) system, hydraulic fluids other than engine oil can be used, but with an unsealed system, with fluid return to the crankcase or a probability of leakage into the crankcase, engine oil or a compatible oil must be employed.

Pumping and/or valving mechanisms are provided external to the piston, preferably external to the engine block and fixed relative thereto. Such mechanisms introduce pressurized fluid through the special conduit to the hydraulic chamber or chambers of the piston to increase the compression ratio, and release fluid from the piston to reduce the compression ratio.

When the hydraulic control mechanism is fixed relative to the engine and positioned outside the engine block, it is conveniently located so that programming inputs can be used to control the control mechanism. Inputs such as gasoline octane rating, engine temperature, exhaust temperature, accelerator position, manifold pressure, engine speed, vehicle speed, etc. can be received by the control mechanism, which in turn controls the compression ratio for optimum performance under the prevailing conditions. An analog or digital computer may be connected to the control mechanism to receive and digest the large number of variables and to effect the proper compression ratio for the existing conditions according to a predetermined program.

Accordingly, in one embodiment the invention comprises a mechanism for varying the compression ratio of an internal combustion piston engine, involving the use of a piston having two portions movable relative to one another to change the height of the piston, through the introduction or removal of hydraulic fluid. Changes in the height of the piston result in changes in the compression ratio of the engine. The hydraulic fluid is introduced into chambers of the hydraulically controlled piston through a special conduit separate from the connecting rod and comprising a movable duct connected to the piston at one end and fixed relative to the engine block at the other end. The hydraulic conduit or duct preferably connects to a control mechanism outside the engine block.

It is therefore broadly among the objects of the invention to provide an apparatus and method for improving engine efficiency through dynamic adjustment of the compression ratio in the firing chamber, such adjustment being accomplished by control of the size of the pistons. A more specific object is to provide such control via hydraulic control, with a special conduit leading from a control device outside the engine block through the crankcase and to the piston, with provisions for accommodating the recipical movement of the piston.

Another object of the invention is to provide for the use of a large number of parameters by the external control device, preferably through use of a computer for receiving input parameters relating to prevailing operating conditions and for instructing the control device accordingly.

Another object of the invention is to provide an engine system utilizing variable compression ratio features, whether externally controlled or not, and also incorporating a supercharger so that under certain conditions, such as under heavy load, the compression ratio of the engine can be substantially reduced and the fuel supercharged, so that a high maximum power output is realized from a small engine. The engine may under most conditions be operated at very high efficiency at a high compression ratio. These features enable the use of a substantially smaller engine than would ordinarily be required.

These and other objects, advantages, and features of the invention will be apparent from the following description of the preferred embodiments, taken in conjunction with the appended drawings.

DESCRIPTION OF THE DRAWINGS

FIG. 4 is another view similar to FIGS. 2 and 3, but showing another modified form of flexible conduit arrangement.

FIG. 5 is a schematic partial view of a piston similar to that of FIG. 2, but including a spring urging two piston sections together.

FIG. 6 is a partial view of a further modified form of piston including a flexible bellows acting as a hydraulic fluid chamber to control the separation of two piston portions, and also schematically indicating a hydraulic control arrangement that may be employed.

FIG. 7 is a schematic representation of another form of piston, with indication of a hydraulic control arrangement.

FIG. 8 is a schematic view of a modified, sealed hydraulic control system connected to a variable compression ratio piston.

DESCRIPTION OF THE PREFERRED EMBODIMENTS SYSTEM SHOWN IN FIG. 1

Figure 1:
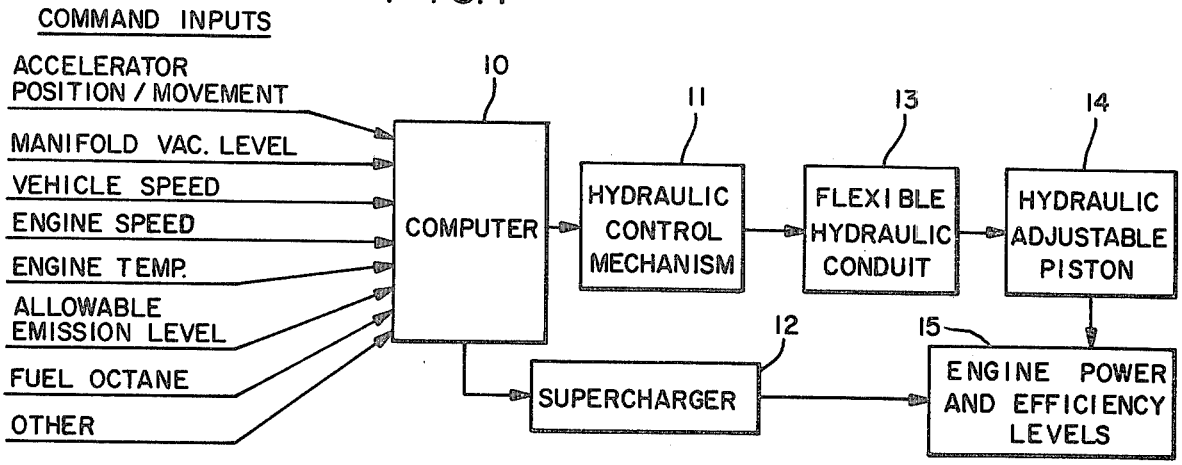
FIG. 1 is a block diagram indicating a system of the invention for an internal combustion engine, including a variable compression ratio piston and a supercharger, and a control system for optimizing efficiency and performance.

In the drawings, FIG. 1 shows in block diagram form a preferred system of the invention, indicating the arrangement of the control and operating mechanisms. As the diagram indicates, a computer 10 is preferably used to control both a hydraulic control mechanism 11 and a supercharger 12. The hydraulic control mechanism is external to the piston and the engine block, being connected to the piston by a flexible hydraulic 13. The hydraulic control mechanism 11 controls the amount of hydraulic fluid delivered through the flexible hydraulic conduit 13 to a hydraulic adjustable piston 14 capable of varying the compression ratio of the engine. Thus, the computer 10 determines desirable compression ratio for the particular prevailing operating conditions of the engine and vehicle, delivers a signal to the hydraulic control mechanims 11 accordingly, and the control mechanism in turn pumps or withdraws fluid as appropriate until the desired compression ratio is obtained by the piston or pistons 14. At the same time, according to this preferred embodiment of the invention, the computer 10 instructs a supercharger 12 at the intake manifold of the engine whether or not and to what extent the fuel charge should be supercharged. As a result, as shown in the block 15 of the diagram, engine power and efficiency levels are constantly regulated by the computer 10 and connected apparatus. Generally, maximum efficiency is achieved under low load or cruise conditions, and this is when the adjustable piston 14 can be set at the maximum compression ratio, the supercharger 12 being deactivated under these conditions. The power output of the engine under such conditions is relatively low, since little power is needed and efficiency is the chief concern.

On the other hand, under generally the opposite conditions, the compression ratio and supercharger settings are very different. Under heavy engine load, such as when the vehicle is going uphill or is accelerating, increased power is necessary. With the compression ratio set at its maximum, and the fuel charge at its normal level, there is very little power, and an opening of the throttle without change in the compression ratio or the nature of the fuel charge would cause severe knocking. Therefore, it is necessary to adjust the compression ratio downwardly under such power demands, and, if the engine is relatively small for the weight of the vehicle, to provide some degree of supercharging of the fuel in order to realize the power needed. Conditions between these extremes may require an intermediate compression ratio setting, without supercharging, or a somewhat reduced compression ratio setting with a mild degree of supercharging.

FIG. 1 shows some of the important engine and vehicle operation inputs to be taken into consideration by the computer 10, according to a predetermined program, in controlling the compression ratio and the use of supercharging. These inputs should include accelerator position and also accelerator movement, which may be used to determine the rate of change of accelerator position, both being relevant to the loading on the engine. Determining the rate of change of accelerator position helps anticipate loading slightly in advance. Manifold vacuum level, also a reflection of engine load, is input to the computer. Both vechile speed and engine speed should be considered, and engine temperature may also be relevant, since detonation or knock often tends to occur more readily when an engine is hot. Other dynamic variables relating to engine operating conditions may be input to the computer 10, if they are relevant to the tendency of knock to occur or to the maximum level at which compression ratio can be maintained without knocking.

Provisions may also be made for manually input and preset parameters relating to engine operation. For example, a setting may be provided for fuel octane, so that this adjustment may be made and left constant so long as the same fuel is being used. Another preset input may be the allowable emission level for the particular vehicle or the geographical area in which it is being operated.

ENGINE OPERATION ILLUSTRATIONS OTTO CYCLE ENGINE EFFICIENCY

The brake engine thermal efficiency, or actual power output/heat value of fuel, has been estimated for conventional engines (Based on Lester C. Lichty, Combustion Engine Processes, McGraw Hill, 1967, pg. 491, FIG. 15-8). Heat and friction losses have been estimated based on these figures and other information. The sum of heat and friction losses and the actual power output are shown in Table I for typical operating conditions for different compression ratios, using conservative figures:

TABLE I

| Compression Ratio | Brake Thermal Efficiency, % of Heat of Fuel | Total Heat & Friction Loss as % of Heat of Fuel | Available Energy for Heat Loss, Friction Loss & Output Power as % of Heat of Fuel |
|---|---|---|---|
| 6:1 | 28% | 9.0% | 37.0% |
| 9:1 | 32% | 10.5% | 42.5% |
| 12:1 | 35% | 12.0% | 47.0% |
| 15:1 | 37% | 13.5% | 50.5% |

The thermal efficiency of the engine increases with increased compression ratio. The heat loss and friction loss also increase with increased compression ratio.

It is known that small engines have less heat and friction loss than large engines, but will not deliver as much power. Reducing the engine size will reduce the engine losses as will be illustrated. Reducing the compression ratio and supercharging will provide the required power on those few occassions when maximum power is needed.

As an approximation, the heat and friction losses will be reduced by $\frac{1}{4}$ if one cylinder is removed from a four cylinder engine or two cylinders removed from an eight cylinder engine. In order to obtain the same power output, the operating conditions of the engine, including the charge per cylinder, will have to be changed. If the engine is operating near optimum, a $\frac{1}{3}$ increase of horsepower has little effect on efficiency; in fact, at constant RPM it tends to improve the efficiency (Lichty, FIG. 15-13). Table II shows the efficiency of an engine similar to that to Table I, except with one in four cylinders removed. The thermal and friction losses have been decreased by approximately 25%, using rounded figures. Thus, for a compression ratio of 6:1, for example, heat and friction losses are lowered by 9%/4, or roughly 2%. As a result of this reduced loss, engine efficiency due to the fewer cylinders rises by about 2%.

TABLE II

| Compression Ratio | Conventional Engine Efficiency | Engine Efficiency with Loss Reduction |
|---|---|---|
| 6:1 | 28% | 30.0% |
| 9:1 | 32% | 34.5% |
| 12:1 | 35% | 38.0% |
| 15:1 | 37% | 40.0% |

The illustrated variable compression ratio engine, assuming operation at 15:1 compression ratio, will be $40/32-1=25\%$ more efficient as compared to a conventional CR=9:1 engine, using the figures of Table II. A conventional engine modified by increasing the compression ratio only, i.e., without the reduced loss feature made possible by increasing the power with reduction of the compression ratio and supercharging, will have an efficiency improvement of only $37/32-1=16\%$, again using the Table II figures.

SUPERCHARGED OTTO CYCLE ENGINE POWER OUTPUT

The combustion chamber of an engine with a constant stroke when adjusted from a compression ratio of 9:1 to 6:1 increases 60%. If the engine is then supercharged so the pressure before ignition is equal to that of the conventional 9:1 engine, the fuel-air charge will be increased by the ratio of the combustion chamber volumes. The power will be reduced by 25% due to the reduction of the number of cylinders. The power will also be reduced by the reduction of efficiency for the VCR engine operating at CR=6:1 as compared to a conventional engine with CR=9:1. From Table II the efficiency is reduced by a factor of $30/32=0.94$. Combining these factors ($1.6\times0.75\times0.94$) shows the VCR engine power output at 6:1, supercharged, is 1.12 times the conventional engine output, even though it has fewer cylinders.

ENGINE POWER REQUIREMENTS

Even with a relatively small engine, the proposed VCR engine will operate with improved efficiency most of the time. The power required to operate a 2500 pound car (including load) under three driving conditions is shown below. The table is for a car of typical aerodynmaics with a frontal area of 25 square feet operating under ideal conditions. (Ref. Edward F. Obert, Internal Combustion Engines and Air Pollution, 1973, pg. 57, equation 2-16b).

TABLE III

| Speed (MPH) | Constant Speed | Gentle Acceleration (1 MPH/Sec) | Moderate Acceleration (3 MPH/Sec) |
|---|---|---|---|
| 30 | 4.4 | 13.5 | 31.7 |
| 40 | 7.8 | 20.0 | 44.4 |
| 50 | 12.7 | 27.9 | 58.3 |
| 60 | 19.5 | 37.8 | 74.4 |
| 70 | 28.8 | 50.1 | 92.7 |
| 80 | 40.9 | 64.3 | 114.1 |
| 90 | 56.1 | 83.5 | 138.3 |

A subcompact car weighing 2500 pounds including a 400 pound load might be supplied with an engine with a peak power output of 70 HP. Good efficiency would probably be obtained up to about 55 HP. Table IV adjusts the 55 HP output to a VCR engine corrected for size of the combustion chamber, the reduced number of cylinders, supercharging for constant pressure (before ignition) and efficiency. The relative efficiency has been compared to a conventional CR=9:1 engine. For example, at 6:1 compression ratio, the horsepower change is 1.12×55HP=approx. 62 HP. In each case, the efficiency factor is given, calculated from Table II by comparison to the 32% efficiency of the conventional 9:1 engine. For each situation, this factor has been multiplied by the per-cylinder volume change factor for the particular compression ratio and by 0.75 for the reduced number of cylinders, to obtain a power factor (not listed). The power factor has been multiplied by 55 HP to obtain the listed power output figures.

TABLE IV

| VCR Engine Compression Ratio | Efficiency Relative to 55 HP optimum output, CR = 9:1 engine. | VCR Engine Output scaled from 55 HP optimum output conventional engine |
|---|---|---|
| 6:1 | .94 | 62 HP |
| 9:1 | 1.08 | 44.5 |
| 12:1 | 1.19 | 35.6 |
| 15:1 | 1.25 | 29.5 |

Comparison of Table III and Table IV, assuming a perfect transmission, shows that the maximum efficiency improvement (i.e., 1.25) will be obtained for steady driving under ideal conditions up to a speed of about 70 MPH. Gentle acceleration up to about 50 MPH will also permit the maximum efficiency improvement. For moderate acceleration at about 40 MPH the VCR engine's compression ratio will decrease to about 9:1, but there will still be an efficiency improvement of about 8%. Moderate acceleration of 50 MPH will result in an efficiency decrease of about 5%. Under most driving conditions the maximum efficiency improvement will be realized. Only under the most adverse and quite infrequent driving conditions will the actual efficiency drop.

It is emphasized that the figures used in the tables and for the calculations herein are approximate, but have been chosen conservatively. Data is not readily available on engine efficiency at 12:1 to 15:1 compression ratios.

EXAMPLES OF PREFERRED VCR PISTON ASSEMBLIES AND CONTROLS (FIGS. 2–10)

Figure 2:
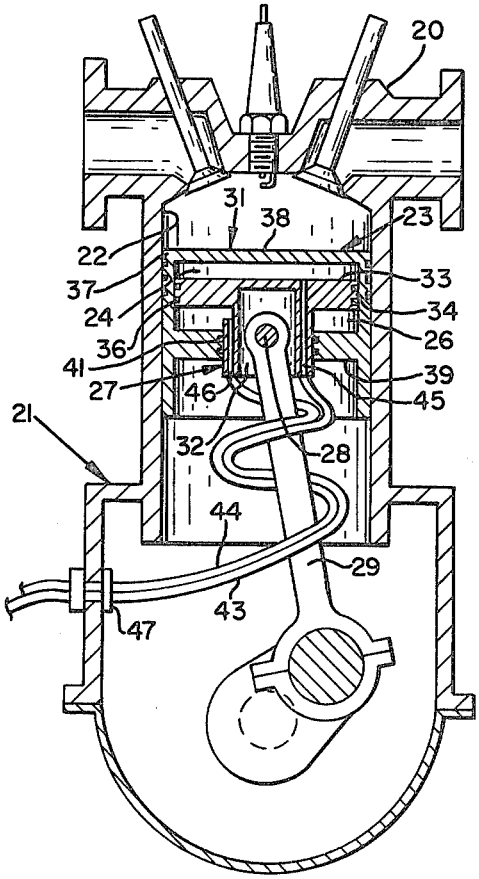
FIG. 2 is a schematic sectional view showing a variable compression ratio compound piston according to the invention, in an engine block cylinder, and with connected flexible hydraulic conduits in a helical arrangement for accommodating piston motion.

FIG. 2 shows in cross-section a head 20, engine block 21 including a combustion cylinder 22, and a variable compression ratio piston 23 according to the invention, as incorporated in an internal combustion engine. In this embodiment two expansible fluid chambers 24 and 26 are included. These are formed by a piston base 27 connected by a wrist pin 28 in the usual way to a connecting rod 29, and a piston cap 31 configured as shown. The base 27 includes a connecting yoke 32 at its lower end, through which the wrist pin 28 passes, only one side of the yoke 32 being shown in FIG. 2, and a wall portion 33 affixed thereto. At the periphery of the wall portion 33 is a cylindrical skirt 34 including some form of slidable sealing means, such as one or more O-rings 36 provided in appropriate grooves. The sealing means 36 cooperates with the relatively movable piston cap 31, via a cylindrical outer wall 37 of the piston cap, similar to the cylindrical wall of a conventional piston. A top end wall 38, again similar to that of a conventional piston, is secured to or integral with the cylindrical body 37, forming the upper expansible fluid chamber 24. Below the base portion wall 33 and connected to the cylindrical body 37 of the cap 31 is a lower wall 39 which may be generally annular in shape, with a central opening to accommodate slidably the connecting yoke 32 of the base portion as shown. Again, the slidable sealing means 41 are provided between the relatively movable surfaces, and the lower expansible fluid chamber 26 is formed between the walls 33 and 39 of the relatively movable piston portions, with the chamber surrounding the central yoke 32.

As can be envisioned from the drawing, expansion of the upper fluid chamber 24 increases the height of the piston assembly and reduces the size of the firing chamber at top dead center piston position, thereby increasing the compression ratio of the piston and the engine. At the same time, the lower chamber 26 is being depleted of hydraulic fluid. Conversly, the upper chamber 24 is drained of fluid while fluid is pumped into the lower chamber 26, when the compression ratio is to be reduced. As illustrated, the fluid supply to the chambers is controlled externally to the piston and to the engine block according to the invention, via hydraulic conduits 43 and 44, serving respectively the upper chamber 24 and the lower chamber 26. Communication of the conduits 43 and 44 with the chambers may be provided by channels 45 and 46 formed in the connecting yoke 32 of the piston base. The flexible conduits 43 must of course reciprocate with the motion of the piston 23, and without interfering with the movement of the connecting rod 29, which includes side-to-side motion. To this end, the conduits preferably have a considerable degree of flexibility and may be shaped in the form of a helix as illustrated, forming a helical path around the connecting rod and then passing to fittings 47 which conduct fluid through the engine block and to the hydraulic control mechanism 11 (FIG. 1). This arrangement tends to minimize the amount of repeated flexure required at any one point on each hydraulic conduit 43 or 44, so that fatigue of the conduits does not cause a failure. The helix shape absorbs the motion in the manner of a light spring. The hydraulic conduits 43 and 44 may be made, for example, of such materials as beryllium-copper, monel or spring steel.

Although the type of variable compression ratio piston assembly 23 illustrated in FIG. 2 has a pair of oppositely-acting expansible fluid control chambers, the helical hydraulic conduit arrangement shown may also be used for a single fluid control chamber embodiment, such as those discussed below and illustrated in FIGS. 3, 4, 5 and 6. Similarily, additional conduits may serve the piston, such as for electrical wiring for monitoring sensors, so that more than two conduits may be provided if desired.

Figure 3:
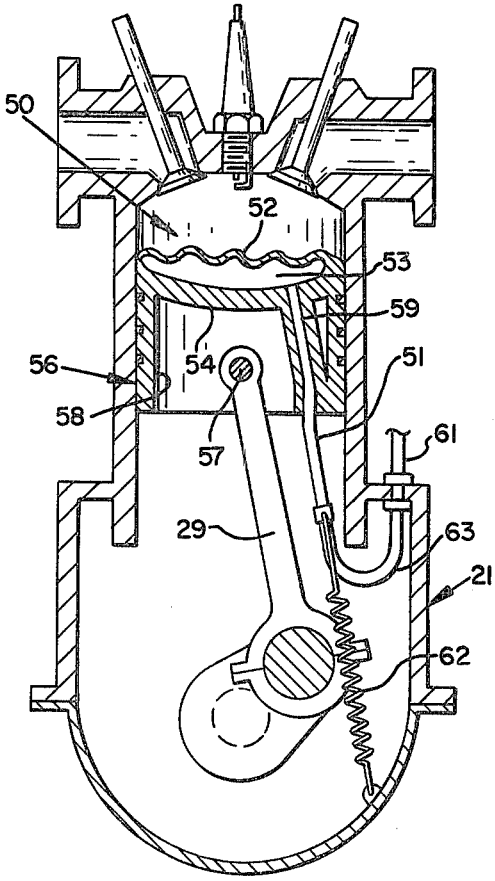
FIG. 3 is a view similar to FIG. 2, showing an alternate form of variable compression ratio piston and an alternate form of flexible conduit arrangement.

FIG. 3 shows a different embodiment of a variable compression ratio piston 50, and a different arrangement for accommodating reciprocating motion in a hydraulic conduit 51. The piston 50, rather than including two relatively slidable portions as in FIG. 3, has a cap portion 52 which is a flexible diaphragm, corrugated as shown to accommodate differences in its configuration depending upon the volume of fluid in an expansible chamber 53 formed between the diaphragm 52 and a wall 54 of the piston base 56. The diaphragm cap 52 may be formed of a suitable material which will permit flexing without fatigue to the point of fracture, such as beryllium-copper. In this embodiment, the connecting rod 29 is connected to the piston base 56 in the conventional manner, by means of a wrist pin 57 passing through the cylindrical body 58 of the piston.

It should be understood that in this embodiment of a variable compression ratio piston, the form of hydraulic conduit shown in FIG. 2 can be used, and may be preferred under some circumstances. Usually only one hydraulic conduit would be provided in this embodiment, although as explained further below, two conduits can be provided if circulation of hydraulic fluid for cooling is desired.

The modified form of hydraulic line arrangement of FIG. 3 includes a rigid tubular portion 59 extending downwardly from the piston base wall 54 as shown, in communication with the chamber 53, and the remaining hydraulic line 51 maybe flexible, formed into a loop and extending to connect with a fitting 61 communications with the exterior of the engine block 21. A tension spring 62 is preferably included, secured to the inside of the engine block 21 as shown, and connected to the flexible line 51 to continually urge it in an orientation which avoids the path of the connecting rod 29. Thus, the lower looped portion 63 of the flexible line 51 remains in a U-shape, but the configuration changes to become a deeper or shallower loop with the reciprocation of the piston.

FIG. 4 shows another modified form of hydraulic line arrangement for a variable compression ratio piston assembly. For purposes of illustration, the type of piston cap 52, providing for variable compression ratio, is shown the same as that of FIG. 3. In this embodiment, a rigid tubular portion 65 of the conduit extends downwardly from the piston base wall 54 as in the FIG. 3 embodiment. The remainder of the conduit is comprised of further rigid tubular portions 66 and 67, connected together and to an exit fitting 61 by pivotable, fluid-sealing joints 68, 69, and 71, respectively. In this way, as in the previously described forms of hydraulic line arrangements, interference with the path of the moving connecting rod 29 is avoided.

FIG. 5 shows another modified form of variable compression ratio piston assembly 75, with the cylinder, engine block and head omitted from this view. As the drawing indicates, a piston cap 76 of this form of the invention has a cylindrical body portion 77 and an end wall 78, with a central post structure 79 extending downwardly from the inside of the end wall 78, preferably integrally formed therewith. At the lower end of the post structure 79 is an outwardly extending flange 81, against which a compression spring 82 bears, urging the flange 81 and the entire cap 76 downwardly with respect to a base 83 of the piston. As indicated, the base 83 of the piston also has a cylindrical body portion 84, secured to or integral with a base portion wall 86, which has a central opening 87 through which the post 79 passes, and appropriate sealing means 88 is provided. Similarly, sealing 89 is provided between the two telescopically fitted cylindrical bodies 84 and 77 of the base 83 and cap 76, respectively. Thus, hydraulic fluid is sealed within an expansible chamber 91 formed between the base and the cap, and the chamber is in communication with a hydraulic conduit 92 which may take the form of a flexible, helical line as indicated for either of the other forms described above.

The spring 82 is included in the form of piston shown in FIG. 5 in order to urge the variable compression ratio piston assembly 75 toward the lower range of compression ratio, and to provide a resistance against inertia forces at the top of the stroke tending to lift the cap 76 off the base 83. The hydraulics of the system also tend to retain the base and cap together, at least to the extent that cavitation would be required in the chamber 91 or the conduit 92 in order to enlarge the chamber 91 beyond the volume of hydraulic fluid present. The spring provides additional restraint, and cavitation does not occur.

FIG. 6 shows a further modified form of variable compression ratio piston assembly 95, wherein a cap 96 and base 97 are telescopically fitted together as shown, each comprising generally a closed ended cylindrical body. No sealing need be provided between these relatively slidable bodies 96 and 97, since a flexible bellows 98 is secured within and between them and forms a fluid chamber 99. The connecting rod 29 is connected by its wrist pin 28 to a rigid inner body 101 secured to the piston base 97 and extending upwardly, reducing the size of the chamber 99 and providing, along with the inner walls of the base portion 97 directly opposite, guidance for the reciprocal movement of the bellows 98. Also, the inner structure 101 provides space for receiving the end of the connecting rod 29, and forms a yoke for seating the wrist pin 28 to connect the piston base 97 and the connecting rod.

A form of hydraulic control assembly 102 is illustrated schematically in FIG. 6. The system is shown as an open system, with hydraulic fluid stored in a sump 103 which may be open to the atmosphere and withdrawn therefrom by a pump 104, which delivers the fluid under pressure through a check valve 106 and a first hydraulic line 107 that may take the form of any of the types of conduit described above, passing through the engine block and up to the fluid chamber 99 in such a way as to avoid interference with the connecting rod 29. In this open-system embodiment, a second hydraulic conduit 108 is provided, adjacent to and secured to the conduit 107, and serving as a return fluid conduit.

The check valve 106 serves the important function of preventing fluid backflow due to shock pressure at each explosion in the firing chamber of the engine cylinder. To prevent undesired flow in the return line 108 due to such shock pressure, a control valve 111 is provided in the line 108 just upstream of the fluid's return to the sump 103. The valve 111, which is a simple on/off flow valve, is closed whenever the compression ratio of the piston is being increased or is maintained constant, and is opened when the compression ratio is to be reduced. Thus, when the ratio is to be increased, the pump 104 is activated and the valve 111 is closed; when the ratio is maintained at a certain level, the pump 104 is inactive and the valve 111 remains closed; when compression ratio is to be reduced, the valve 111 is simply opened to return fluid to the sump, until the desired ratio is reached. These control functions can be governed by a computer 112, operably connected to the pump 104 and to the control valve 111 as indicated. For determining when the desired compression ratio is obtained, according to a predetermined program and according to some or all of the inputs discussed above in connection with FIG. 1, a pressure sensor 113 is included in the hydraulic delivery line 107 and operably connected to the computer 112, so that the pressure may be monitored at top dead center or other appropriate position of the piston's stroke, and this pressure will reflect the pressure in the firing chamber at that point and thus the compression ratio of the piston.

Because of dynamic factors involved in the movement of hydraulic fluid and the rapid reciprocating action of the piston 95, it may be necessary to position a pressure transducer 114 somewhere in the actual fluid chamber 99 of the piston. For this purpose, a third conduit 116 may be provided, following the same path as the other conduits 107 and 108, and this may lead to the computer 112 in place of or as a supplement to the pressure sensor 113 in the line 107. In FIG. 6 a dashed line 117 indicates connection of the pressure transducer or sensor 114 to the computer 112, via the flexible conduit 116.

It should be understood that under many circumstances the bellows type variable compression ratio piston assembly 95 of FIG. 6 would be controlled with a single hydraulic line, in a closed system whereby fluid is simply moved into or out of the chamber 99 through the single hydraulic line, with pressure continually maintained on the fluid. Such a control system will be described below in reference to FIG. 8. However, the dual hydraulic line, open system 102 is shown in FIG. 6 for situations where circulation of fluid is desirable, as for cooling of the fluid and the piston assembly. To this end, there may be associated with the sump 103 an appropriate cooling device 118, and this may be simply an arrangement whereby the fluid passing through the sump and associated hydraulic lines is partially cooled by the effects of relatively cooler parts of the engine or relatively cooler air in the vicinity.

FIG. 7 schematically indicates a hydraulic control system 119 similar in many respects to the system of FIG. 6, connected to a dual-chamber variable compression ratio piston assembly 121, which may be similar to the piston assembly shown in FIG. 2. In this arrangement, dual hydraulic lines 122 and 123 to the piston assembly 121 with its upper, or increase-compression chamber 124 and its lower, or decrease-compression chamber 126, do not circulate fluid but act oppositely to one another. That is, when compression ratio is increased by a pumping of fluid through the line 122, fluid is at the same time being drained from the piston through the line 123. This may be accomplished by a single pump 104, and valves 127 and 128 in the hydraulic lines 122 and 123, each of which has three positions: closed, so that fluid cannot pass through it in either direction; open, so that fluid is pumped into the hydraulic 122 or 123 by the pump 104; and a drain position, whereby the line 122 is connected directly to a drain line 129 into the sump 103, or the hydraulic line 123 is connected directly to a drain line 131 into the sump, as shown. In this third mode of each of the valves 127 and 128, the pump 104 is valved off from that particular valve and associated hydraulic line. Appropriate control of the valve 127, the valve 128, and the pump 104 is effected by the computer 112. As in the previous embodiment, a pressure sensor 113 may be included in the hydraulic line 122, and one may additionally be provided in the line 123 (not shown) if needed.

In operation of the hydraulic control system 119 of FIG. 7, when inputs to the computer 112 indicate that a higher compression ratio is desirable in the piston assembly 121, the computer activates the pump 104 and opens the control valve 127 and moves the control valve 128 to the drain position. Therefore, the pump withdraws fluid from the sump 103 and delivers it through the valve 127 and the hydraulic line 122 to the upper chamber 124 of the piston, expanding it and increasing the compression ratio, while reducing the size of the lower chamber 126. Accordingly, fluid is drained from the chamber 126 through the line 123 and the valve 128 to the sump. When the compression ratio has reached the desired level, both control valves 127 and 128 are closed, and the pump 104 is deactivated. In this mode the pump 104 is isolated from the compression shock exerted on the piston 121 and its fluid chambers 124 and 126, since the valves 127 and 128 are both fully closed.

When the compression ratio is to be reduced, the pump 104 is again activated, but this time with the control valve 128 open to deliver fluid through the line 123, with the control valve 127 in the draining position.

Alternatively, the system 119 of FIG. 7 could be modified to a closed system, with fluid retained in the chambers, lines and pump and not circulated to an open sump. If the pump 104 is reversible, or appropriate valving is included, the sump 103 can be eliminated, with the valves 127 and 128 simple on/off valves, and when a change in the compression ratio of the piston 121 is desired the pump can simply withdraw fluid from one of the lines 122 or 123 and deliver it into the other. Thus, in such an arrangement the two on/off valves would both be open during changes in the compression ratio, and both closed under constant compression ratio to isolate the pump from compression shocks.

FIG. 8 shows a closed system hydraulic control arrangement 135 which can be used with any of the single-chamber type variable compression ratio pistons described above. The system is closed in the sense that it is totally sealed with the fluid contained. For purposes of illustration, a piston assembly 50 similar to that of FIG. 3 is shown here. For pressurization of the piston assembly 50, an expandable control bellows 136 connects to the chamber 137 of the piston through a hydraulic line 138. Contraction of the control bellows 136 pushes fluid through the line 138 and expands the chamber 137. Of course, the opposite is true when the compression ratio is to be reduced.

The control system 135 illustrated in FIG. 8 is designed to develop a high pressure in the bellows 136 for control of the piston 50 by use of a relatively small motor 139. High pressures are required to add fluid to the chamber 137 during firing, and the illustrated system 135 is efficient for this purpose.

In the system 135, a bearing plate 140 at the rear of the control bellows 136 is borne against by a member 141 which is rigidly attached to a threaded shaft 142. Threadedly connected to the shaft 142 is a rotatable shaft 143, appropriately supported for rotation and against translation by bearings 144. Thus, great mechanical advantage obtains when the shaft 143 is rotated, since the threaded connection between the two shafts 143 and 142 causes a small amount of translation of the bellows bearing plate 140 for each relatively large increment of rotation of the shaft 143. For rotation of the shaft 143, the motor 139 is engaged therewith by a worm gear 146, enmeshed with a receiving worm gear 147 on the shaft 143, as illustrated. Thus, a much greater mechanical advantage is added by the worm gear arrangement, and together, the threaded shaft and worm gear connections can develop great fluid pressures in the control valves 136 by means of a very small motor 139, which is reversible so that the piston chamber 137 can be controlled in both directions. Of course the worm gear and the threaded connection are both self locking with respect to back-loading from the control bellows under conditons of peak pressure, so the control mechanism does not tend to back off regardless of the size of the motor 139.

Figure 9:
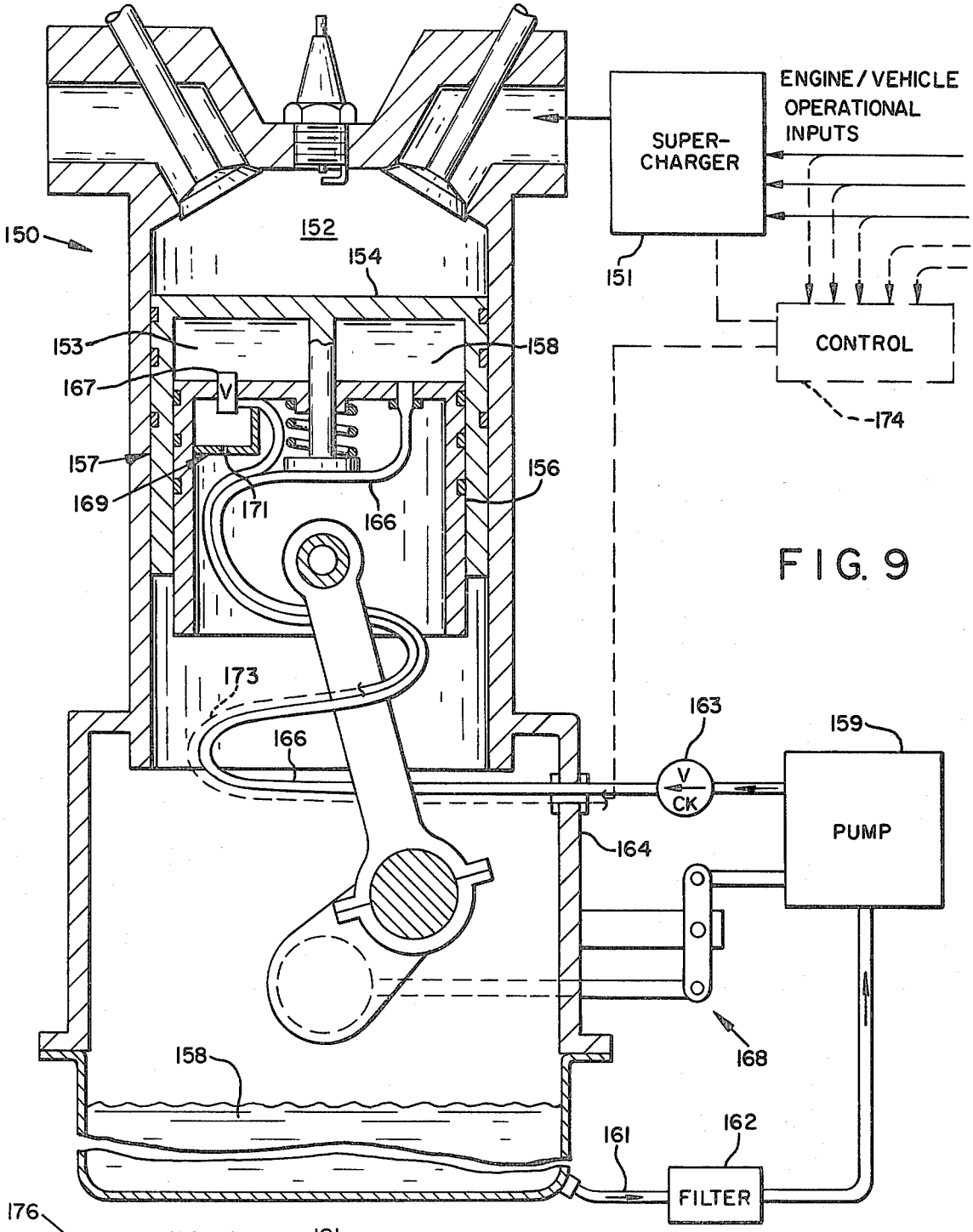
FIG. 9 is a schematic view of a modified system wherein crankcase oil from the engine is used as hydraulic fluid and compression ratio is controlled by maintaining a generally constant peak pressure in the firing chamber, with supercharging to add power when needed.

FIG. 9 shows a modified variable compression ratio piston assembly and system which does not include external control of the compression ratio in the sense of the systems described above. In this system 150, a supercharger 151 is included and is operably connected to relevant engine/ vehicle operation inputs such as accelerator position and rate of change of position, manifold pressure and vehicle speed, so as to initiate supercharging when conditions demand greater power. Under such conditions, the super-charger forces a pressurized charge into the combustion chamber 152, and pressure therein is accordingly increased. Peak pressure in the firing chamber 152 is therefore increased significantly, and this increase is also reflected in an expansible fluid chamber 153 between a movable cap portion 154 and a base portion 156 of the variable compression ratio piston 157. The piston 157 may be a simple single chamber assembly, as also described above with reference to FIG. 5. In this embodiment, oil 158 from the engine's crankcase is preferably utilized for pressurizing the chamber 153 of the piston, so that the oil may be dumped directly back into the crankcase when the cap portion of 154 of the piston is to be retracted. Thus, crankcase oil is drawn by a pump 159 through a line 161 from the crankcase, through an oil filter 162, and delivered through a check valve 163 through the crankcase wall 164 and a flexible line 166 (which may take any of the forms described above) to the expansible fluid chamber 153.

When the supercharger 151 is activated as described above, the pressure of the hydraulic fluid (crankcase oil) within the chamber 153 rises significantly. A relief valve 167 is provided in communication with the chamber 153 to relieve pressure and release oil from the chamber 153 whenever pressure rises above a preselected value. Thus, when operating conditions are such that supercharging is required, pressures in the firing chamber 152 and in the hydraulic fluid 153 rise to the point that oil is vented through the relief valve 167 and returned to the crankcase. This has the effect of retracting the movable cap portion 154 of the piston automatically, and therefore reducing the compression ratio of the engine even though peak pressure is maintained approximately the same. With peak pressure the same, but volume of the combustion chamber 152 at top dead center increased, more power is produced by a larger charge. At the same time, the compression ratio has been reduced, so that knock does not occur.

It is preferable that the volume in the expansible fluid chamber 153 of the piston 157 be changed in small increments. This is true primarily because the pump 159 is more preferably adapted to be constantly operational in exerting pressure to push oil through the line 166 toward the fluid chamber 153. Fluid is moved by the pump into the chamber 153 not at peak pressure but at the lower cylinder pressures that occur between explosions in the cylinder. In the intake cycle (without supercharging) there is vacuum in the chamber 152, so that without a limitation on the pump 159, large increases in the fluid volume in the expansible chamber 153 could be expected to occur, only to be reversed when peak pressure occurs and the piston cap 154 is forced back downwardly. Therefore, both the pump 159 and the relief valve 167 are preferably structured to work in small increments. The pump may advantageously be a reciprocating type pump, connected by linkage 168 which is illustrated only for example, operable directly from the rotation of the engine's crankshaft. The mechanically operated reciprocal pump 159 therefore pumps incrementally. Preferably, the pumped increments of fluid are small so that the amount of increase in volume in the fluid chamber 153 of the piston, for each cycle, is limited to a definite quantity. Thus, an increase in the compression ratio from an old value to a desired new value, based on conditions, requires several cycles, perhaps even ten to fifteen cycles or more, to complete. In a given cycle therefore, only a very small increment of increase in the fluid chamber volume occurs. This may occur even when the engine is operating under a steady state condition such as cruise; the small volume increase is reversed again at peak pressure by venting excess pressure (and volume) through the relief valve 167.

When supercharging is initiated and peak pressure rises, the relief valve 167 discharges fluid faster than it is admitted by the pump 159, and the piston cap 154 retracts to lower the compression ratio. However, the compression ratio preferably is not lowered to its desired value in one or a few cycles. Instead, it should be lowered somewhat gradually, and this is accomplished by limiting the outflow of fluid from the relief valve 167 in each cycle. Such limitation can be provided, for example, by an enclosure 169 below the relief valve, through which all fluid exiting the valve 167 must flow. An orifice 171 in a wall of the enclosure limits the rate of flow of fluid out to the crankcase, but still has the effect of permitting somewhat higher outflow under higher pressures.

The relief valve 167 is operable to reduce compression ratio even without supercharging, under certain conditions. Thus, under load when peak pressure rises and ordinarily would cause knock, fluid is vented from the chamber 153 to lower the compression ratio somewhat, until conditions change again.

It should be understood that the pump 159 can be located inside the engine's crankcase if desired, or mounted on the engine block in the same manner as a typical oil pump is mounted.

The assembly shown in FIG. 9 tends to bring about small losses due to the inevitable small increase and decrease of volume in the fluid chamber 153 in every cycle, and the attendant loss of work. Such surges are very small and are acceptable, since the system still produces great increase in overall engine efficiency. The principal advantage of this system, in comparison with others described above, is its simplicity.

A variation to the system of FIG. 9 is shown therein. The relief valve 167 may optionally be a variable-threshold relief valve, with a control linkage line 173 leading from the valve alongside the hydraulic line 166 and out of the crankcase to an external control device 174.

The valve 167 may be pilot-pressure operated to provide the variable threshold, in which case the control line 173 would be a fluid conduit. Alternatively, the valve may have a electrical pressure threshold control, as by a solenoid (not shown), and the line 173 would then be a conduit with electric wiring inside. In either case, the control device 174 external to the engine block regulates the setting of the relief valve 167 according to engine and vehicle operation inputs as indicated in the drawing. The control 174, receiving the inputs directly (dashed lines in FIG. 9), may also regulate the operation of the supercharger 151. Adjustability of the pressure at which the relief valve vents fluid from the piston chamber 153 enables closer control of the compression ratio and better matching of the ratio to the wide variety of operating conditions encountered.

Figure 10:
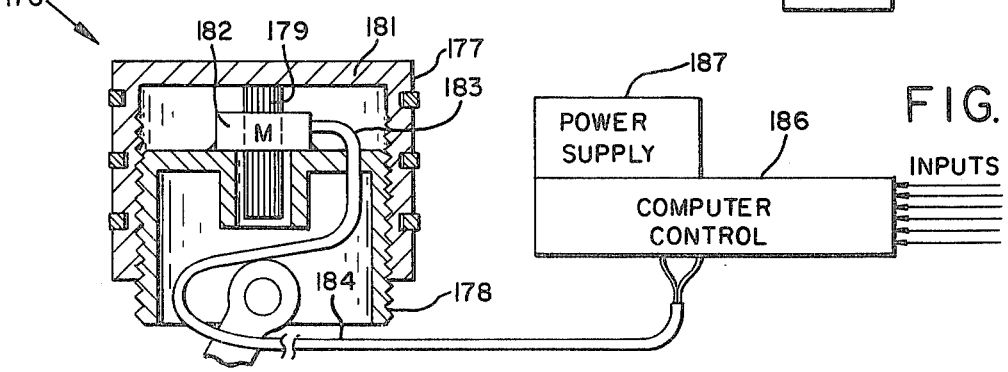
FIG. 10 is a schematic view showing a modified form of variable compression ratio piston assembly wherein the position of a movable piston cap portion is controlled by an electric motor.

If FIG. 10 there is illustrated another variation of the invention. A variable compression ratio piston 176 has a movable cap portion 177 which is received in a screw-threaded connections on a base 178 as indicated schematically in the figure. A long, shaft-like gear 179 is rigidly attached to and extends downwardly from the end wall 181 of the piston cap, and it is engaged by a motor and reduction gearing assembly 182 mounted on the top of the piston base portion 178 as shown. Electrical wiring 183 from the motor assembly passes through base portion 178 and through a conduit 184 (which may be similar to any of those described above), out of the engine block to a computerized control device 186. The control device 186 is connected to a power supply 187 for supplying power to the motor assembly 182. The operation of this piston assembly is substantially as described above for the hydraulically operated embodiments. A supercharger may be used with this system, also in the same manner as described earlier.

From the above description it is seen that the invention encompasses several variations of engines and assemblies including an adjustable, variable compression ratio piston. One principal feature of the invention is the provision of an adjustable piston with control external to the engine block, permitting complete adjustment for any variation of operating conditions. Supercharging may advantageously be used with such a system, but not necessarily. The mechanism for adjusting the piston may take any of several forms. Another very important feature of the invention is the use of supercharging in combination with any type of variable compression ratio piston, whether externally controlled or not, so that compression ratio may be lowered and supercharging introduced to increase power when needed. Under conditions requiring lower power, the compression ratio is maintained relatively high, without supercharging. The invention includes methods, as well as apparatus, for performing these functions. Other important features of the invention include the specific preferred structures shown and described above.

The embodiments described herein are illustrative of the principles of the invention but are not intended to limit the scope of the invention. Variations to these preferred embodiments will be apparent to those skilled in the art and may be made without departing from the essence and scope of the invention.

I claim:

1. A variable compression ratio piston assembly for an internal combustion engine having at least one firing chamber defined between a piston and or upper end of a cylinder, comprising:

a piston base and a pivotally attached connecting rod within a cylinder of an engine block;

a movable piston cap portion connected to the base and having an outer end positioned outwardly of the base, constituting a boundary of the firing chamber of the cylinder;

adjustment means associated with and operable between the piston base and the movable piston cap portion for moving the movable portion to adjust the resulting compression ratio of the piston and cylinder, comprising an expansible fluid chamber between the piston base and the movable cap portion, operable to move the movable portion in response to changes in volume of hydraulic fluid in the expansible fluid chamber;

control means external to the engine block for regulating the adjustment means to provide a desired compression ratio;

a hydraulic conduit connecting the adjustment means and the control means, connected to the piston base and in communication with the expansible fluid chamber, said conduit passing through the cylinder out of a path of the connecting rod and out through a wall of the engine block, with means for accommodating reciprocal piston motion;

computer means connected to the control means for receiving input information pertaining to the condition of operation of the engine and formulating input command signals according to a predetermined program, and sending the signals to the hydraulic control means to control the compression ratio;

whereby the compression ratio of the piston and cylinder can be controlled externally to the engine while the engine is operating.

2. A variable compression ratio piston assembly for an internal combustion engine having at least one firing chamber defined between a piston and an upper end of a cylinder, comprising:

a piston base and a pivotally attached connecting rod within a cylinder of an engine block;

a movable piston cap portion connected to the base and having an outer end positioned outwardly of the base, constituting a boundary of the firing chamber of the cylinder;

adjustment means associated with and operable between the piston base and the movable piston cap portion for moving the movable portion to adjust the resulting compression ratio of the piston and cylinder;

control means external to the engine block for regulating the adjustment means to provide a desired compression ratio;

means connecting the adjustment means and the control means, including means for accommodating reciprocal piston motion, the connecting means being flexible and having a portion near the piston arranged generally helically around the connecting rod, to flex with the motion of the piston and connecting rod, whereby the compression of the piston and cylinder can be controlled externally to the engine while the engine is operating.

3. A variable compression ratio piston assembly for an internal combustion engine having at least one firing chamber defined between a piston and an upper end of a cylinder, comprising:

a piston base and a pivotally attached connecting rod within a cylinder of an engine block;

a movable piston cap portion connected to the base and having an outer end positioned outwardly of the base, constituting a boundary of the firing chamber of the cylinder;

means associated with the piston base and the movable cap portion for defining an expansible fluid chamber between them for moving the movable portion in response to change in volume of hydraulic fluid in the fluid chamber;

a hydraulic fluid channel comprising a fluid conduit connected to the piston base and in communication with the expansible fluid chamber, said conduit being positioned adjacent to but separate from the connecting rod and passing through the cylinder out of contact with and out of a path of the connecting rod and out through a wall of the engine block, said conduit being flexible with a portion of the conduit near the piston being arranged generally helically around the connecting rod, to flex with the motion of the piston and connecting rod, to accommodate reciprocal piston motion without interference from the piston and the connecting rod; and hydraulic control means external to the engine block and connected to the hydraulic conduit for adjusting the volume of hydraulic fluid in the fluid chamber in response to changes in operating conditions of the engine;

whereby the compression ratio of the piston and cylinder can be controlled externally to the engine while the engine is operating.

4. A variable compression ratio piston assembly for an internal combustion engine having at least one firing chamber defined between a piston and an upper end of a cylinder, comprising:

a piston base and pivotally attached connecting rod within a cylinder of an engine block;

a movable piston cap portion connected to the base and having an outer end positioned outwardly of the base, constituting a boundary of the firing chamber of the cylinder;

means associated with the piston base and the movable cap portion for defining an expansible fluid chamber between then for moving the movable portion for defining an expansible fluid chamber between them for moving the movable portion in response to changes in volume of hydraulic fluid in the fluid chamber;

a hydraulic fluid channel comprising a fluid conduit connected to the piston base and in communication with the expansible fluid chamber, said conduit being positioned adjacent to but separate from the connecting rod and passing through the cylinder out of contact with and out of a path of the connecting rod and passing through the cylinder out of contact with and out of the path of the connecting rod and out through a wall of the engine block;

means associated with the hydraulic fluid conduit for accommodating reciprocal piston motion without interference from the piston and the connecting rod;

hydraulic control means external to the engine block and connected to the hydraulic conduit for adjusting the volume of hydraulic fluid in the fluid chamber in response to changes in operating conditions of the engine; and two oppositely-acting expansible fluid chambers being formed by said means associated with the piston base and cap portion, a first being positioned to increase compression ratio when pressurized and a second being positioned to reduce compression ratio when pressurized, and including two hydraulic conduits, one connected to each of the chambers, so that as hydraulic fluid is introduced to one chamber, fluid is withdrawn from the other, and including open-system hydraulic control means positioned outside the engine block and connected to the two hydraulic conduits, for regulating the pressurization of said chambers and the compression ratio of the piston;

whereby the compression ratio of the piston and cylinder can be controlled externally to the engine while the engine is operating.

5. A variable compression ratio piston assembly for an internal combustion engine having at least one firing chamber defined between a piston and an upper end of a cylinder, comprising:

a piston base and a pivotally attached connecting rod within a cylinder of an engine block;

a movable piston cap portion connected to the base and having an outer end positioned outwardly of the base, constituting a boundary of the firing chamber of the cylinder;

means associated with the piston base and the movable cap portion for defining an expansible fluid chamber between them for moving the movable portion in response to changes in volume of hydraulic fluid in the fluid chamber;

a hydraulic fluid channel comprising a fluid conduit connected to the piston base and in communication with the expansible fluid chamber, said conduit being positioned adjacent to but separate from the connecting rod and passing through the cylinder out of contact with and out of a path of connecting rod and out through a wall of the engine block;

means associated with the hydraulic fluid for accommodating reciprocal piston motion without interference from the piston and the connecting rod;

hydraulic control means external to the engine block and connected to the hydraulic conduit for adjusting the volume of hydraulic fluid in the fluid chamber in response to changes in operating conditions of the engine;

an additional return hydraulic conduit is connected to the piston base and in communication with the expansible fluid chamber, and said external control means comprising an open-system hydraulic control means positioned outside the engine block and connected to the hydraulic conduits, for admitting pressurized hydraulic fluid to the expansible fluid chamber of the piston through one conduit and withdrawing fluid through the return conduit, in response to input command signals, said hydraulic control means including an open hydraulic sump, a pump for delivering fluid from the sump through the one hydraulic fluid conduit, a valve in the return hydraulic fluid conduit for selectively relieving the pressure in the chamber and returning fluid to the sump, and a check valve in the one hydraulic fluid conduit to assure one-way fluid flow; and computer means connected to the hydraulic control means for receiving input information pertaining to the condition of operation of the engine and formulating input command signals according to a predetermined program, and sending the signals to the hydraulic control means to control the compression ratio.

6. A variable compression ratio internal combustion engine, comprising:

a variable compression ratio piston assembly with a base and a movable cap portion, within a cylinder of an engine block;

an expansible fluid chamber between the piston base and the movable cap portion for moving the movable portion in response to changes in volume of hydraulic fluid in the expansible fluid chamber, for adjusting the compression ratio of the piston and cylinder;

control means external to the engine block and connected to an adjustment means for controlling the adjustment of the compression ratio;

a supercharger for increasing fuel charge to engine cylinders; and means associated with the expansible fluid chamber and the supercharger for controlling the compression ratio and the supercharger to maintain a high compression ratio with no supercharging, to lower the compression ratio and add supercharging, and to regulate the compression ratio between high and low values, all according to power demands and other conditions of operating of the engine, and comprising computer means for receiving input information pertaining to the condition of operation of the engine and formulating input command signals according to a predetermined program and sending the signals to the control means and the super-charger to maintain the compression ratio and supercharging as desired.

7. A variable compression ratio internal combustion engine, comprising:

a variable compression ratio piston assembly with a base and a movable cap portion, within a cylinder of an engine block;

adjustment means comprising an expansible fluid chamber between the piston base and the movable cap portion for moving the movable portion in response to changes in volume of hydraulic fluid in the expansible fluid chamber, to adjust the resulting compression ratio of the piston and cylinder:

a supercharger for increasing fuel charge to engine cylinders; and a hydraulic fluid pump for delivering fluid under pressure into the expansible fluid chamber to increase the compression ratio, a pressure relief valve associated with the expansible fluid chamber for relieving pressure and contracting the chamber over a preset pressure limit value to reduce the compression ratio, including relief valve control means external to the engine block for adjusting threshold pressure at which the relief valve vents fluid from the expansible fluid chamber, and means external to the engine block for controlling the supercharger for activation according to engine operating conditions, whereby supercharging increases peak cylinder pressure to vent pressure through the relief valve, regulating the compression ratio according to the degree of supercharging, so that the compression ratio is maintained high without supercharging, is lowered with supercharging, and is regulated between high and low valves all according to power demands and other conditions of operation of the engine.

8. A variable compression ratio piston assembly for an internal combustion engine having at least one firing chamber defined between a piston and an upper end of a cylinder, comprising:

a piston base and a pivotally attached connecting rod within a cylinder of an engine block;

a movable piston cap portion connected to the base and having an outer end positioned outwardly of the base, constituting a boundary of the firing chamber of the cylinder;

means associated with the piston base and the movable cap portion for defining an expansible fluid chamber between them for moving the movable portion in response to changes in volume of hydraulic fluid in the fluid chamber;

a hydraulic fluid channel comprising a fluid conduit connected to the piston base and in communication with the expansible fluid chamber, said conduit being positioned adjacent to but separate from the connecting rod and passing through the cylinder out of contact with and out of a path of the connecting rod and out through a wall of the engine block;

means associated with the hydraulic fluid conduit for accommodating reciprocal piston motion without interference from the piston and the connecting rod;

hydraulic control means external to the engine block and connected to the hydraulic conduit for adjusting the volume of hydraulic fluid in the fluid chamber in response to changes in operating conditions of the engine; and computer means connected to the hydraulic control means for receiving input information pertaining to conditions of operation of the engine and formulating input command signals according to a predetermined program, and sending the signals to the hydraulic control means to control the compression ratio;

whereby the compression ratio of the piston and cylinder can be controlled externally to the engine while the engine is operating.

9. The piston assembly of claim 8, said computer means having means for receiving both fixed and variable input information and formulating input command signals therefrom, with means providing for manually setting said fixed input information.

10. A variable compression ratio piston assembly for an internal combustion engine having at least one firing chamber defined between a piston and an upper end of a cylinder, comprising:

a piston base and a pivotally attached connecting rod within a cylinder of an engine block;

a movable piston cap portion connected to the base and having an outer end positioned outwardly of the base, constituting a boundary of the firing chamber of the cylinder;

means associated with the piston base and the movable cap portion for defining an expansible fluid chamber between them for moving the movable portion in response to changes in volume of hydraulic fluid in the fluid chamber;

a pressure relief valve in communication with the expansible fluid chamber for relieving fluid pressure, and means for conducting fluid from the relief valve away from the chamber;

means for adjusting the pressure at which said pressure relief valve is opened;

a hydraulic conduit connected to the piston base and in communication with the expansible fluid chamber, said conduit passing through the cylinder out of a path of the connecting rod and out through a wall of the engine block; and means associated with the hydraulic conduit for accommodating reciprocal piston motion, whereby hydraulic fluid may be admitted through the conduit, and whereby pressure in the expansible fluid chamber is limited by the relief valve, thereby providing an upper limit to compression ratio.

11. The piston assembly of claim 10, wherein said adjusting means includes means for controlling the relief valve from a position external to the engine block.

12. The piston assembly of claim 10, wherein said relief valve adjusting means includes control linkage for regulating the setting of the relief valve from a position external to the engine block, and including an additional conduit attached to and movable with said hydraulic conduit for

13. An internal combustion engine having at least one firing chamber defined between a piston and an upper end of a cylinder, and including a variable compression ratio piston assembly, comprising:

a piston base and a pivotally attached connecting rod within a cylinder of an engine block;

a movable piston cap portion connected to the base and having an outer end positioned outwardly of the base, constituting a boundary of the firing chamber of the cylinder;

means associated with the piston base and the movable cap portion for defining an expansible fluid chamber between them for moving the movable portion in response to changes in volume of hydraulic fluid in the fluid chamber;

a hydraulic fluid channel comprising a fluid conduit connected to the piston base and in communication with the expansible fluid chamber, said conduit being positioned adjacent to but separate from the connecting rod and passing through the cylinder out of contact with and out of a path of the connecting rod and out through a wall of the engine block;

means associated with the hydraulic fluid conduit for accommodating the reciprocal piston motion without interference from the piston and the connecting rod; and hydraulic control means positioned outside the engine block and connected to the hydraulic conduit, for admitting pressurized hydraulic fluid to the expansible fluid chamber of the piston and withdrawing fluid, in response to input command signals responsive to changes in operating conditions of the engine, a supercharger for increasing the fuel charge to the engine cylinders, and computer means connected to the hydraulic control means and the supercharger for receiving input information pertaining to the condition of operation of the engine and formulating input command signals according to a predetermined program and sending the signals to the hydraulic control means and the supercharger to maintain a high compression ratio and no supercharging, to lower the compression ratio and add supercharging, and to regulate the compression ratio between high and low values, all according to power demands and other conditions of operation of the engine.

14. The internal combustion engine of claim 13, wherein said computer means includes means for receiving input information relating to accelerator position and movement, manifold vacuum level, vehicle speed, and engine speed.

15. The internal combustion engine of claim 14, wherein the computer means further includes means for receiving fixed, manually set input information relating to the octane of the fuel being used and the permissible emission level for the vehicle.

* * * * *